US006237153B1

(12) United States Patent
Bowens

(10) Patent No.: US 6,237,153 B1
(45) Date of Patent: May 29, 2001

(54) HOSPITAL GARMENT

(76) Inventor: Sarah Bowens, 2722 Plymouth Dr., Easton, PA (US) 18045

( * ) Notice: Subject to any disclaimer, the term of this patent is extended or adjusted under 35 U.S.C. 154(b) by 0 days.

(21) Appl. No.: 09/451,039

(22) Filed: Nov. 29, 1999

(51) Int. Cl.[7] ..... A41D 13/00
(52) U.S. Cl. ..... 2/114; 2/69
(58) Field of Search ..... 2/69, 114, 105, 2/83, 46, 100, 115, 80, 104

(56) References Cited

U.S. PATENT DOCUMENTS

| | | | |
|---|---|---|---|
| D. 378,157 | | 2/1997 | Jagger . |
| 1,462,515 | | 7/1923 | McElroy . |
| 1,522,499 | | 1/1925 | Corn . |
| 1,731,137 | | 10/1929 | Jones . |
| 2,425,402 | | 8/1947 | Sieloff . |
| 3,771,172 | | 11/1973 | Barg . |
| 4,686,714 | | 8/1987 | Harley . |
| 4,737,995 | | 4/1988 | Wiley . |
| 4,975,984 | | 12/1990 | Sting . |
| 5,150,477 | * | 9/1992 | Elberson et al. ..... 2/114 |
| 5,611,087 | | 3/1997 | Adkins . |
| 5,640,715 | | 6/1997 | Adams . |
| 5,768,707 | | 6/1998 | Lederer . |
| 6,012,166 | * | 1/2000 | Burbidge ..... 2/83 |
| 6,012,168 | | 1/2000 | Hutton et al. . |
| 6,032,288 | * | 3/2000 | Simone ..... 2/69 |

* cited by examiner

*Primary Examiner*—Gloria M. Hale
(74) *Attorney, Agent, or Firm*—Charles A. Wilkinson

(57) ABSTRACT

A garment primarily for use as a hospital gown having three adjacent panels with the central panel being sandwiched between the outer panels. Two of the panels are unitary, while the third panel is split into two sections along a more or less vertical line and held together by a fastening means. The garment may be worn with the human torso disposed between the split or openable panel and the central unitary panel, or between the central panel and outer unitary panel. The gown provides added dignity to the wearer as well warmth and protection from cold drafts, while still allowing the wearer's body to be easily and quickly accessed through the gap between the side seams of the middle and third panels.

29 Claims, 11 Drawing Sheets

HOSPITAL GARMENT

BACKGROUND OF THE INVENTION

1. Field of the Invention

This invention relates to garments in general, and more particularly to gowns worn by hospital patients for medical examination or treatment.

2. Preliminary Discussion

The typical garment, whether designed to cover the upper or lower portion of the body, can only be worn in one orientation or position, and usually covers the body with a single layer of fabric such as cotton, wool, and the like. In particular, the standard hospital or examination gown is usually made from flimsy single layered panels having flaps in the back that are held together by metal fasteners or cloth ties.

Such prior art gowns are used by hospitals for several reasons. First, hospitals are under constant pressure to control or cut costs, and the standard gown is relatively inexpensive to manufacture and launder. Second, medical personnel need to have substantially unencumbered access to areas of the body that have been injured and need to be examined or treated, and the gown must be loose enough so that bulky dressings such as, for example, a heavy bandage or a cast on a broken bone, can be easily applied and tended to and will fit under the gown. Third, hospital gowns must be easily put on or removed, since many patients are at least partially immobilized and incapable of dressing themselves without the assistance of a nurse or other hospital staff. In addition, bedridden patients that require the use of a bed pan need a gown that is adaptable to their needs.

Although the standard hospital gown has some practical advantages, it has an even greater number of drawbacks. First, hospital gowns are notorious for providing only a modicum of covering and dignity for patients. The rear flaps of most gowns often tend to be pulled or split apart as the patient moves around while performing simple normal activities such as walking to the bathroom or moving to a different examination area and the like. As a result, patients wearing the standard gown are often unknowingly or even knowingly subjected to embarrassing exposure. In addition, many hospitals or examination areas are often uncomfortably cold, either due to a need for continual air-conditioning, which usually cannot be regulated by the patient, or, in colder climates, the heat might be kept at a relatively low level to save on heating costs. The flimsy box-like construction of the standard gown provides little or no warmth to patients in drafty and cold hospitals or convalescent homes, and patients often are unable to or are prohibited from wearing any additional clothing.

Standard hospital gowns also often do not provide easy access to the front or shoulder parts of the body without necessitating undue exposure, since the only opening in such gowns is in the back, and if the gown is reversed, excessive exposure of the front, particularly of female patients, inevitably ensues. For instance, a patient with a wound on his or her shoulder would necessarily have to remove practically the entire gown during examination. In addition, patients are often subjected to unnecessary exertion due to the lack of adaptability of such gowns to various treatments required in nursing. For example, due to the clumsy design and construction of the standard gown, a mother suffering from exhaustion following the birth of a child would be forced into undue exposure of other portions of her body in order to expose her breast while nursing. In addition, nerve shock caused by critical operations, severe accidents and prolonged periods of pain often causes the body to be extremely sensitive to air and the touch of human hands irrespective of how gentle an effort is made to administer any necessary treatment and assistance. The present garment now in use requires undue manipulation and exacts a wholly unnecessary toll from such patients.

Numerous attempts have been made to overcome the disadvantages of the standard hospital gown by providing a gown that gives the patient some additional covering while still allowing for easy access to the body for examination and medical treatment. However, in general these attempts have not been successful, either because such gowns are too expensive to manufacture or are too impractical or complicated in design. Thus, the problems associated with the standard gown still exist, and such gowns are still in widespread use in hospitals, nursing homes, and the like. Some cultures are particularly sensitive to exposure, and family members often aid their relatives in activities that require dressing and undressing, such as taking baths and the like, rather than relying on aid from hospital personnel or attendants. In fact, hospital gown comfort and coverage has become such an important issue in some communities that a bill was recently sponsored in one legislature that would require hospitals to give admitted patients the option of wearing "dignity gowns," which completely cover the patient from neck to knees, unless a standard hospital gown is medically necessary for patient treatment and care. However, hospitals have objected to the bill since it would significantly increase their costs, which increase would ultimately be passed to consumers. Thus, while many hospitals have been made aware of the need for an alternative gown that allows their patients, often now referred to as clients, to retain their integrity and affords them the dignity and respect they deserve, there is still a need for an alternative to the standard hospital gown that is practical, relatively inexpensive, and overcomes the disadvantages associated with the standard gown.

The present inventor has met the challenge and designed a hospital gown that overcomes the described problems and is both simple and inexpensive. The present inventor departs from the construction of the standard garment by providing a three or tri-panelled gown wherein one of the panels is sandwiched between the other two. While one of the outer panels is split or openable similar to the flaps on the standard hospital gown, the present inventor has added a solid or unitary panel between the two outer panels. The addition of a middle or central panel gives the wearer the option of wearing the gown with his or her body positioned either between two solid panels or between one solid panel and one openable or split panel. In addition, by using hook & loop type or equivalent closures on the shoulder area, the gown may be unhooked and easily slipped on or removed from the body of the wearer with a minimum amount of physical effort to the patient. The shoulder of the patient can also be easily attended to without exposing other portions of the body. Thus, the patient may easily slip either between or from the two solid or unitary panels almost as easily as opening the split panel in putting on or taking off the gown. Furthermore, while the two unitary panels do not usually require fastenings on the openable side, because of the split flaps on the outside, securing means may be provided, if desired, to attach the side of the middle or central panel to the other unitary panel.

When the patient desires a closed gown or a "dignity gown," the garment may be positioned with his or her body between the two relatively unopenable or solid panels. Such orientation not only protects the patient against unwanted and embarrassing exposures, but also provides additional warmth and protection from drafts and the cold. On the other hand, when the patient expects to be examined or treated in a manner necessitating that the gown be openable, the gown can be worn with the body between the central unopenable panel and the outer openable or split panel, with the split panel facing or covering either the front or back of the patient as required.

The gown of the present inventor is designed to meet all requirements of post-operative care, and allows access for applying dressings, bandaging, intravenous feeding, blood transfusions, blood tests, and intravenous anesthesia. When abdominal or chest examination or treatment is necessary, the gown may be worn with the split panel covering the front of the body. On the other hand, when backside bandaging or treatment is necessary, or if a bed-pan is in use, the gown may be worn with the split panel covering the patient's back area. The garment also allows the use of casts on the upper arm and shoulder without destruction of the garment since the sleeve is separable.

Thus, the present invention provides a hospital garment that is equally adequate for patients where access to either the front or back portions of the body for examination or operation is necessary, or for ambulatory or extended care patients in nursing homes and the like where easy access to the body through an openable panel is not as critical and who desire additional security against unwanted and embarrassing exposure. The garment also provides added warmth and comfort as opposed to traditional hospital gowns. The patient, for example, can choose to oppose the double thickness of cloth of the garment or gown to the coolest portion of the his or her body, frequently the back, which tends to be more easily chilled. This is possible whether the patient is between the unitary or solid portions of the gown or within the openable or split portion of the gown.

3. Description of the Related Art

The prior art evidences numerous designs for hospital gowns and other garments having a protective or additional modesty layer over the standard layer. The prior art known to the applicant does not, however, contemplate a garment comprising the elements of the present invention. Some of the prior art references of note are as follows.

U.S. Pat. No. 1,462,515 issued to E. McElroy on Jul. 23, 1923, entitled "Hospital Gown," discloses a hospital gown wherein essentially the entire gown is individually separable at the side seams so that small portions of the body may be exposed for examination or operation without exposing the entire body. Such gown does not contemplate the use of a third or middle panel, however.

U.S. Pat. No. 1,731,137 issued to M. R. Jones on Oct. 8, 1929, entitled "Garment," discloses a dress having a removable outer piece that functions as an apron or a protective layer for such dress.

U.S. Pat. No. 2,425,402 issued to 0. Sieloff on Aug. 12, 1947, entitled "Infant's Garment," discloses a garment for an infant forming both an undergarment, or an inner garment, and an outer garment both in front and back. The infant can be dressed between the back panel and either one of the two side panels so that there is a double layer of cloth over the back and front of the infant, with the two front layers folded out from opposite sides to go over the child consecutively. However, the Sieloff reference does not illustrate positioning between two one-piece panels or a one-piece and a two-piece, divided panel.

U.S. Pat. No. 2,582,772 issued to M. Egbert on Jan. 15, 1952, entitled "Combination Garment," discloses a jacket having a combined liner and shell that may either be worn separately or together as is commonly seen with ski jackets and winter jackets today. Such construction is dissimilar to that contemplated in the present invention.

U.S. Pat. No. 3,771,172 issued to H. Barg on Nov. 13, 1973, entitled "Bathing Suit," discloses a bathing suit having both an inner and outer garment wherein the inner garment provides control for the users body parts while the outer garment is merely provided for decoration. The garment is designed to be worn in only one orientation, however.

U.S. Pat. No. 4,737,995 issued to D. Wiley on Apr. 19, 1988, entitled "Child's Hospital Uniform," shows a hospital uniform having separable body portions. The shoulders are separable to gain access to the upper part of the child's body, and the rear panel is also separable in the normal fashion as with most conventional hospital garments. However, there is no mention whatsoever of having a tri-panel garment similar to the proposed invention.

U.S. Pat. No. 4,975,984 issued to B. J. Sting on Dec. 11, 1990, entitled "One-Piece Garment," discloses a garment having two panels that extend along either the front or back of a persons body to completely cover the front and rear torso, as well as two closable side panels extending from either the front or rear panel to provide additional coverage to both the sides and either the front or back of the wearer of the garment. The Sting reference actually provides the wearer with more coverage than the conventional hospital gown, but does not rise to the same type of coverage as the present inventor's hospital gown.

U.S. Pat. No. 5,640,715 issued to J. S. Adams on Jun. 24, 1997, entitled "Hideable Protective Front Member for Clothing," discloses a detachable bib or panel that is positionable over the front portion of a wearer's shirt to serve as a protective panel for protection against spills of foods, beverages, industrial substances and the like.

U.S. Pat. No. 5,768,707 issued to B. L. Lederer on Jun. 23, 1998, entitled "Examination Gown," discloses a multi-panelled examination uniform primarily for female wearers during gynecological examinations. Both the front and back panels of the torso portion of the gown are openable for inspection by a medical official. However, the gown itself is essentially a two piece skirt and blouse combination with openable portions at strategic locations.

The prior art thus completely fails to disclose a garment or hospital gown design having a third or middle panel wherein the garment can be worn with the body situated between either the first and second or second and third panels. Furthermore, the prior art does not disclose a hospital gown that gives the patient the option of wearing the gown with one panel being split or openable or with both panels being relatively unopenable or unitary.

OBJECTS OF THE INVENTION

It is an object of the present invention, therefore, to provide an improved hospital or examination gown.

It is a further object of the invention to provide a hospital or examination gown that may be easily and inexpensively manufactured similar to the standard hospital gown using only one additional middle panel.

It is a still further object of the invention to provide a hospital or examination gown which can be worn similarly to the typical present gown in wide use or that can be used as a dignity gown.

It is a still further object of the invention to provide a hospital or examination gown having two unopenable or solid panels and one openable or split panel.

It is a still further object of the invention to provide a hospital or examination gown wherein the body of the patient can be worn either between two unopenable panels or between one openable panel and one unopenable panel.

It is a still further object of the invention to provide a hospital gown wherein the body of the patient can be easily moved from a position between two unopenable panels to a position between one openable and one unopenable panel and vice versa without having to remove the entire gown.

It is a still further object of the invention to provide a hospital or examination gown that can be worn with the openable panel covering either the front or back portion of the body of the patient.

It is a still further object of the invention to provide a hospital or examination gown that allows for easy access to the portion of the body of the patient without subjecting the patient to unnecessary exposure and loss of dignity.

It is a still further object of the invention to provide a hospital or examination gown that does not subject the patient to unnecessary exposure while not being examined.

It is a still further object of the invention to provide a hospital gown that is easily put on or removed from the body of the wearer.

It is a still further object of the invention to provide a hospital gown that is warm and provides additional protection from drafts and the cold.

Still other objects and advantages of the invention will become evident upon review of the following detailed description in conjunction with the appended drawings.

SUMMARY OF THE INVENTION

The present invention in its main embodiment provides a garment primarily for use as a hospital gown having three panels instead of the standard two panels, with the extra panel being sandwiched between the outer panels. Two of the panels are unitary and are comprised of a single piece of material, while the third panel is split into two pieces or halves along a more or less vertical line, creating essentially mirror image openable flaps which are held together by a fastening means such as cloth ties.

Conventional hospital gowns consist of a single layer of material that is openable only in the back and is held together by cloth ties or the like. Such gowns do not provide adequate covering or dignity to the wearer, and the slightest movement or draft can subject the patient to unwanted exposure and loss of dignity. In addition, the standard gown is quite flimsy and provides little or no warmth to the wearer, and often does not provide adequate access to portions of the body that need to be examined or treated without removing the gown or lifting the gown up and under the neck.

To correct the flaws in the standard hospital garment, the present inventor provides a garment that can be worn in several ways depending on the needs and wishes of the wearer and the physician. If the garment is worn by a patient who needs to be examined or treated, the gown may be worn with his or her body between the split or openable panel and the central unitary panel, with the openable panel covering the area of the patient's torso to be examined or treated. If the wearer does not need to examined immediately, or if the wearer desires additional protection from exposure and loss of dignity, the garment can be worn with the central panel on the same side of the body as the openable panel. While such orientation provides dignity to the wearer as well additional warmth and protection from cold drafts, the wearer's body can still be easily and quickly accessed and treated through the gap or space between the side seams of the middle and third panels.

The non-traditional design of the present invention, in addition to affording hospitals the ability to treat their patients or clients with the dignity and respect they deserve by providing protection from accidental exposure, also provides a warmer, more versatile alternative to the standard hospital gown that is also inexpensive to manufacture.

DESCRIPTION OF THE PREFERRED EMBODIMENTS

Figure 1:
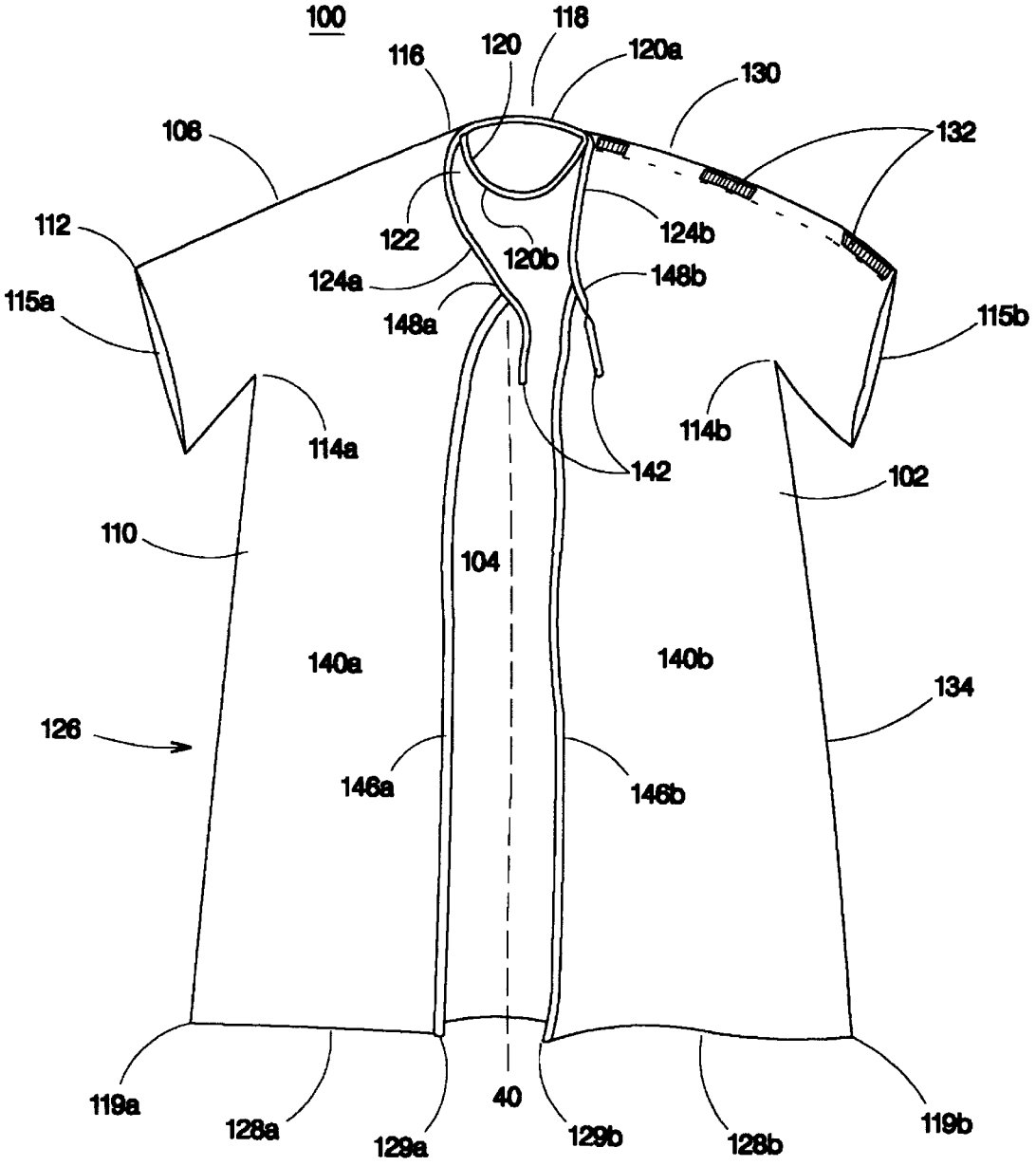
FIG. 1 is an isometric view of the garment of the invention with the openable or split panel, situated or viewed in front of the two unitary panels.

As described, the hospital gown of the invention has been developed to remedy a number of the defects of present day hospital gowns which gowns tend to separate along their tie line when worn by a patient, exposing the body of the patient not only to the view of others, but exposing the patient to cold air, if the surroundings are cool, as hospital environments often are. To remedy the defects of prior hospital gowns, the present inventor has added an additional full internal panel between the opening panel and the usual full panel. This allows the patient's body to be accommodated either between the outer two openable half panels and a full panel backed by a second full panel, i.e. the outer full panel, or, alternatively, between two full panels, one of which is the central panel backed by the two half panels. To facilitate putting on and taking off the hospital gown of the invention, not only are the two half panels separable more or less vertically along the panel formed of two half panels, but at least one of the half panels separates from the opposite full panel along the shoulder and sleeve portion, the two being ordinarily secured to each other along such sections through preferably hook and loop connections, but also snaps, buttons or other suitable connections. Likewise, the central panel between the two half panels and the outer full panel is secured to at least the one of the half sections separatably attached to the full outer panels or alternatively to the full outer panel itself opposite the half panel. Alternatively, the outer full panel can be temporarily secured to the inner or central full panel and the outer half panel can also be secured along the shoulder section to the inner or central full panel. Since the central panel will not extend, however, into the sleeve portion, the outer full panel and one of the half panels will be secured to each other along the shoulder and sleeve portion of the garment on one side of the garment and the inner or central full panel will then be secured to one or both of the outer panels. The panels can be temporarily secured to each other along both shoulder portions, but the integrity and intrinsic strength and convenience of the arrangement is ordinarily improved by having only one shoulder section open. If it is necessary for a medical procedure to access one of the shoulders of the patient for treatment or examination, the patient will put on the gown with the two half panels either in the front or back of the patient as appropriate to have the opening shoulder section on the proper side. As will be recognized, the use of the new gown of the invention solves many of the disadvantages of presently available gowns not only by providing a central dignity panel in the gown, but by providing several alternative ways for entrance into or removing the gown and dispositions of the patient within the gown.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

A three-panelled body garment embodying the principles of the present invention is illustrated in FIGS. 1–14. FIG. 1 is an isometric view of the garment 100 having three panels, a first split or openable panel 102, a second central or middle panel 104, and a third or full panel 106. The central panel 104 of the invention is positioned such that it is between the openable panel 102 and the full panel 106. In FIG. 1, the third panel 106 (not shown) is situated behind or underneath panels 102 and 104, the central panel 104 is sandwiched between the outer panels 102 and 106, and the first panel 102 is in front of panels 104 and 106. Such body garment is preferably suited for use as a hospital gown, but could be adapted to be worn as a shirt, painting smock, dress, or other similar type garment.

Each of the panels 102–106 is preferably made from a continuous sheet of woven textile fabric, although alternatively the panels could be pieced together from separate smaller sheets to form similar panels. Each panel is preferably formed by cutting the fabric from a pattern. The edges of the panels are then finished and sewn along the seam lines. If possible, the thread should be of a material similar to that of the fabric of the panels. Any suitable fabric could be used to form the garment 100, depending on the preference or needs of the hospital or facility where the garment is to be used. However, the fabric should be durable enough to withstand frequent washing at high temperatures. A different fabric could be used in manufacturing the central panel; however, each panel is made from the same material in the preferred embodiment. Each panel is of sufficient dimensions so as to cover a human body substantially from the torso to the knee area.

The peripheral edge 126 of the garment 100 includes a first shoulder seam 108, a first side seam 110, a second shoulder seam 130, and a second side seam 134. First panel 102 has bottom edges 128*a* and 128*b* that are substantially horizontal, and meet the first and second side seams 110 and 134 at the corners 119*a* and 119*b*, respectively. The panels of the garment are generally wider at their bottom edges than at the sleeve edges, giving the panels of the garment more of an A-shaped appearance, although the panels could have the same width at both the sleeve and the bottom edges. The first side seam 110 extends from corner 119*a* upwardly to point 114*a*, wherein arm opening 115*a* is formed. Similarly, the second side seam 134 extends from point 119*b* upwardly to point 114*b*, wherein arm opening 115*b* is formed.

Each of the panels 102–106 of the illustrated embodiment is permanently attached to the other panels by sewing or hemming along the first shoulder seam 108 from the top edge 112 of the first arm opening 115*a* to the neck edge 116 of the first neck opening 118, and along the first side seam 110 of the peripheral edge 126. The first neck opening 118 is generally shaped to accommodate the neck region of the wearer and is formed by the first neck edge 120 of the middle and third panels 104 and 106, with the first part 120*a* on the third panel 106 and second part 120*b* on the second or middle panel 104. The garment also has a second neck opening 122, which is formed by the second neck edge 124, having a first part 120*a* on the third panel 106 in common with the first neck edge 120, and second and third parts 124*a* and 124*b* on the first panel 102. The first and third panels 102 and 106 are permanently attached or sewn along the second side seam 134 of the peripheral edge 126; however, the middle panel 104 is not connected to the other panels along the seam 134, although a detachable fastening means such as hook and loop fastening means could be provided in an alternative embodiment.

The panels 102–106 are detachably connected along the second shoulder seam 130 of the peripheral edge 126 by hook and loop fasteners 132 (shown in more detail in FIGS. 11–13) so that the garment can be easily opened along the shoulder seam 130 by unfastening the fasteners 132. As will be explained in more detail below, the panels 102, 104, and 106 can be individually detached along the shoulder seam 130. Individual hook and loop fasteners 132 can be placed along the shoulder seam 130 in spaced apart relation as in FIG. 1, or alternatively a continuous strip or other combination of such fasteners can be used. Other fastening means such as snaps, buttons, and the like could also be used interchangeably with the hook and loop fasteners.

Referring again to FIG. 1, the first panel 102 is split along a vertical axis 40 into two substantially mirror image pieces or flaps 140*a* and 140*b*. Inner edges 146*a* and 146*b* extend generally vertically from the bottom edges 128*a* and 128*b*, forming the inner corners 129*a* and *b*, and meet the second neck edge 124 at points 148*a* and *b*. Ties 142 or other suitable connecting means are used to hold the flaps 140*a* and 140*b* closed or together, and are attached to the garment at points 148*a* and *b*. Additional ties may also be positioned along the inner edges 146*a* and 146*b* of the split panel 102 as needed. The flaps 140*a* and 140*b* may also be made to overlap such that they remain closed more effectively, for example, by moving one of the ties 142 inwardly from the inner edge 146*a* or *b*.

Figure 2:
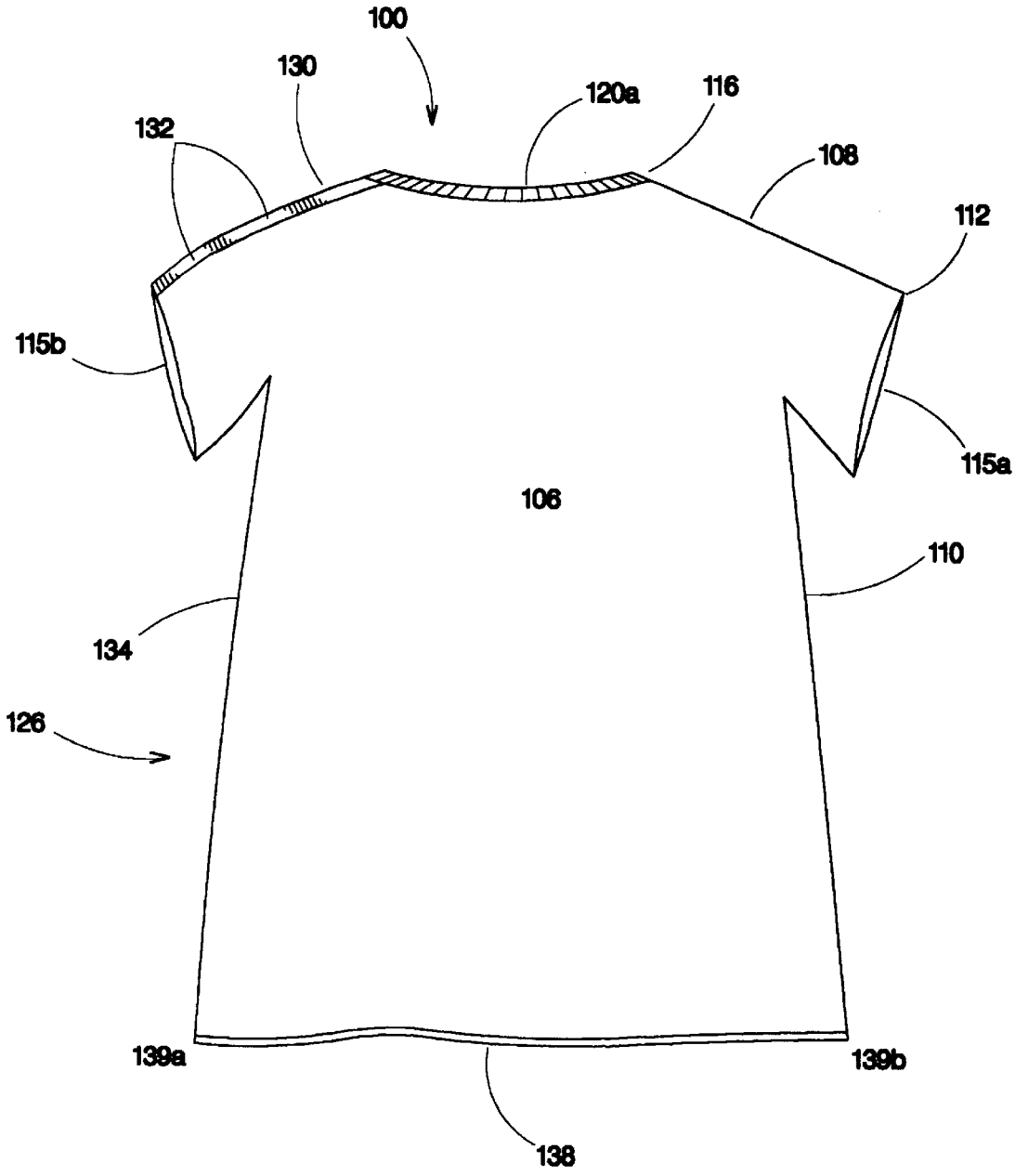
FIG. 2 is an isometric view of the garment of the invention with the outer unitary panel situated in front of the other panels.

FIG. 2 is an isometric view of the body garment 100 situated so that the third unitary or full panel 106 is in front of the first and second panels 102 and 104 (not shown). The bottom edge 138 of the panel 106 meets the first side seam 110 and second side seam 134 of the garment 100 forming the corners 139*a* and *b*. The third panel 106 is not split or openable and completely covers substantially the entire torso portion of the patient. The panel 106 is permanently connected to both the first panel 102 and central panel 104 along the first shoulder seam 108 and first side seam 110, and is permanently connected to just the first panel 102 along the second side seam 134. Access to the shoulder portion along the second shoulder seam 130 is available by detaching the hook and loop fasteners 132.

Figure 3:
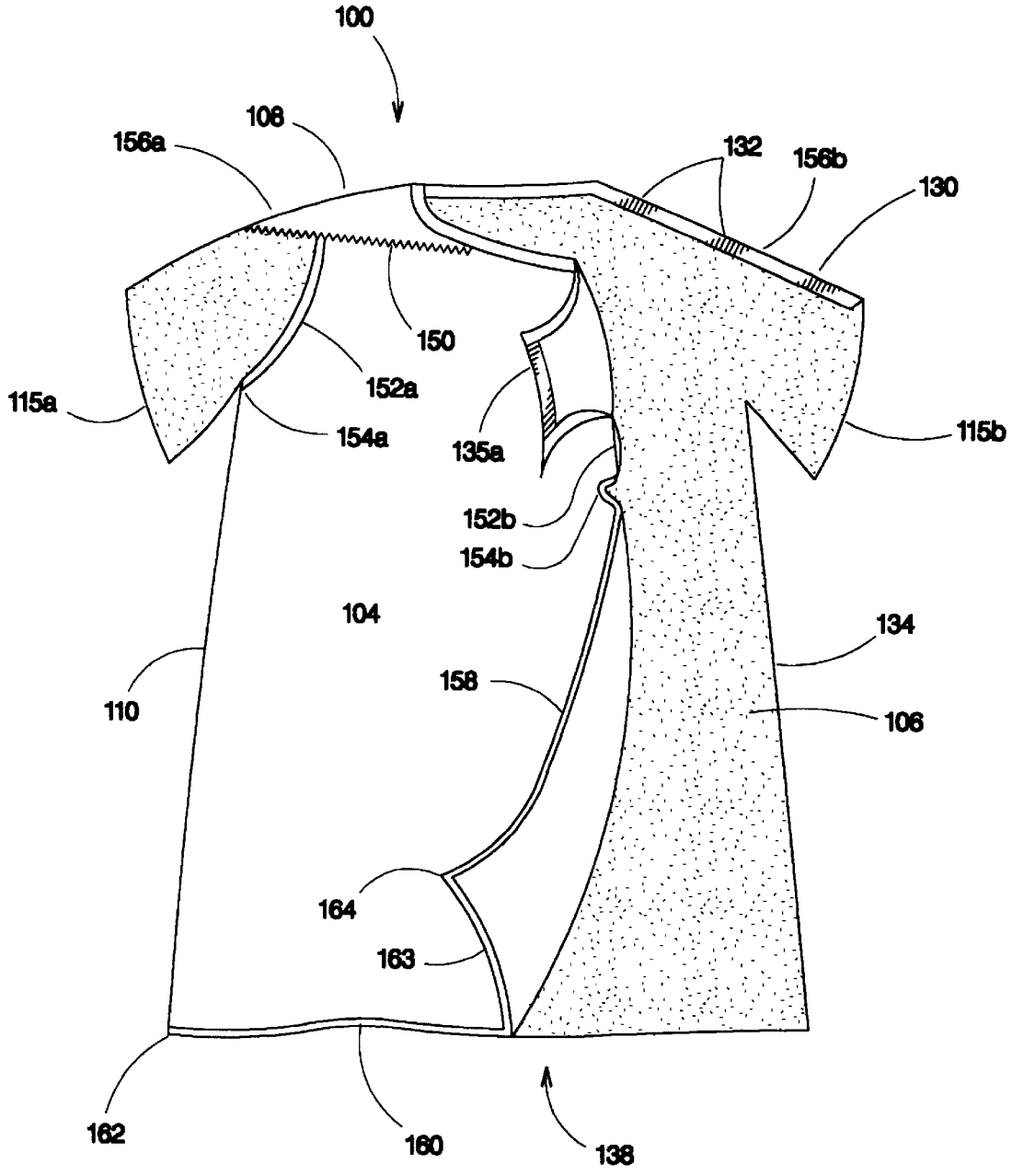
FIG. 3 is an isometric view of the garment of the invention similar to FIG. 1 with the openable panel cut away or removed to show the unitary panels underneath and with a portion of the central panel folded over to show the third panel.

FIG. 3 is an isometric view showing the middle panel 104 of the body garment 100 with the first panel 102 cut away along the jagged line 150, and with a portion of the middle panel 104 folded back to reveal the inner side of the third panel 106, with the third panel 106 shown as the dotted, or stippled, portion. In the illustrated embodiment, the central panel 104 is permanently connected to the outer panels 102 and 106 along the first shoulder seam 108 and first side seam 110, while it is detachably connected along the second shoulder seam 130. Note that in the illustrated embodiment, central panel 104 does not have sleeve portions, with the sleeve portions 115*a* and 115*b* of the garment 100 being formed from the interconnection of the outer panels. Arm edge 152*a* extends from the first shoulder seam 108 from approximately the point 156*a* on such shoulder seam and meets the first side seam 110 at the point 154*a*. Similarly, arm edge 152*b* extends from the second shoulder seam 130 (130 on the turned back portion of the middle panel 104) at the point 156*b* and extends to meet the openable edge 158 at the point 154*b*. The bottom edge 160 of the middle panel 104 meets the garment side seam 110 at the corner 162, and such bottom edge 160 meets the openable edge 158 of the middle panel 104 at the corner 164. Note again that the middle panel 104 is not attached to either the first panel 102 (not shown in FIG. 3) or third panel 106 along the openable edge 158. Thus, a patient who wishes to put on the body garment 100 can do so by unfastening the hook and loop fasteners 132 and slipping his or her body between the openable edge 158 of the middle panel 104 and the edge 134 of the third panel 106 and then reattaching the fasteners 132 as will be described in more detail below.

Figure 4:
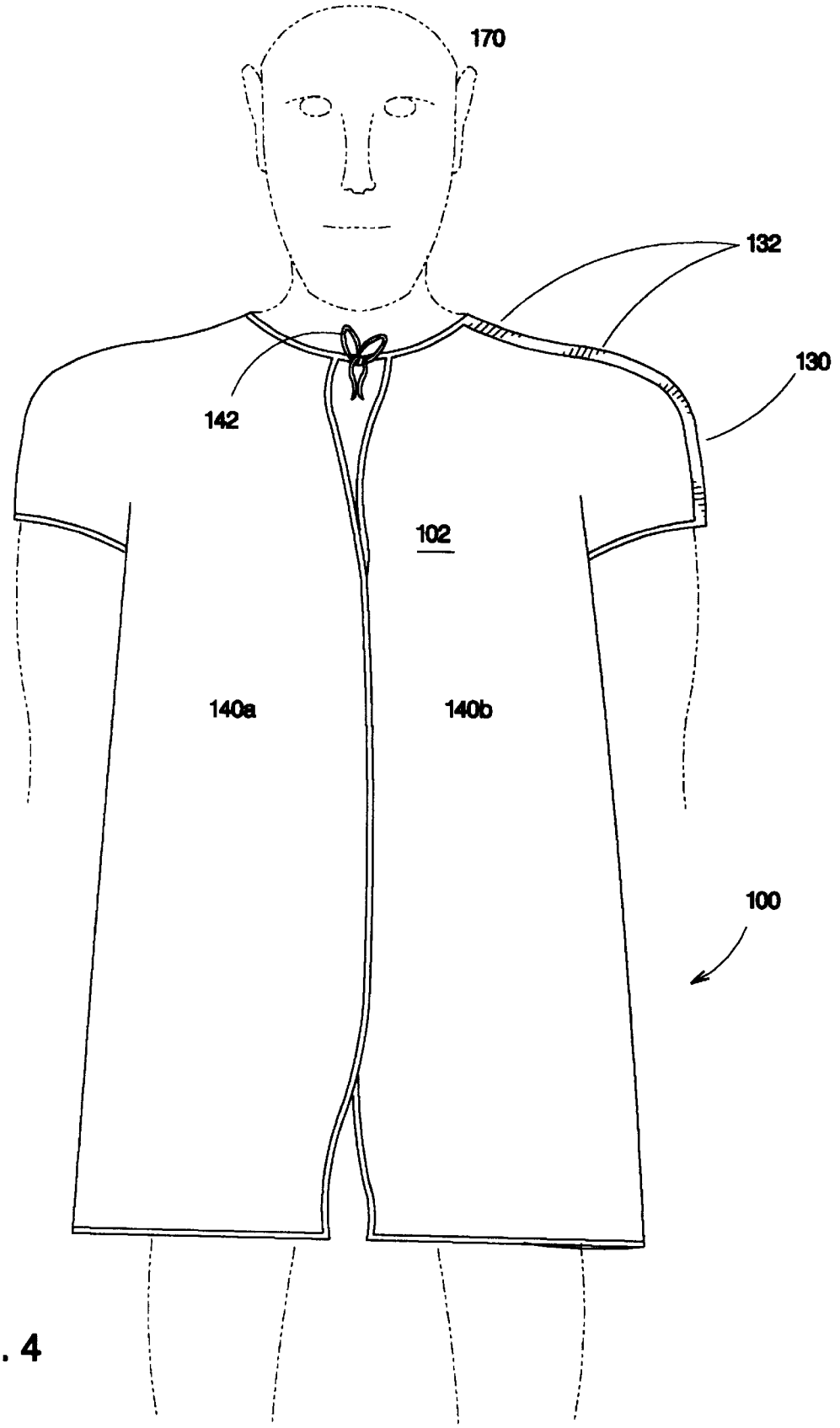
FIG. 4 is a view of a patient wearing the garment of the invention with the two halves of the openable panel tied or secured together and covering the front of the patient.
Figure 5:
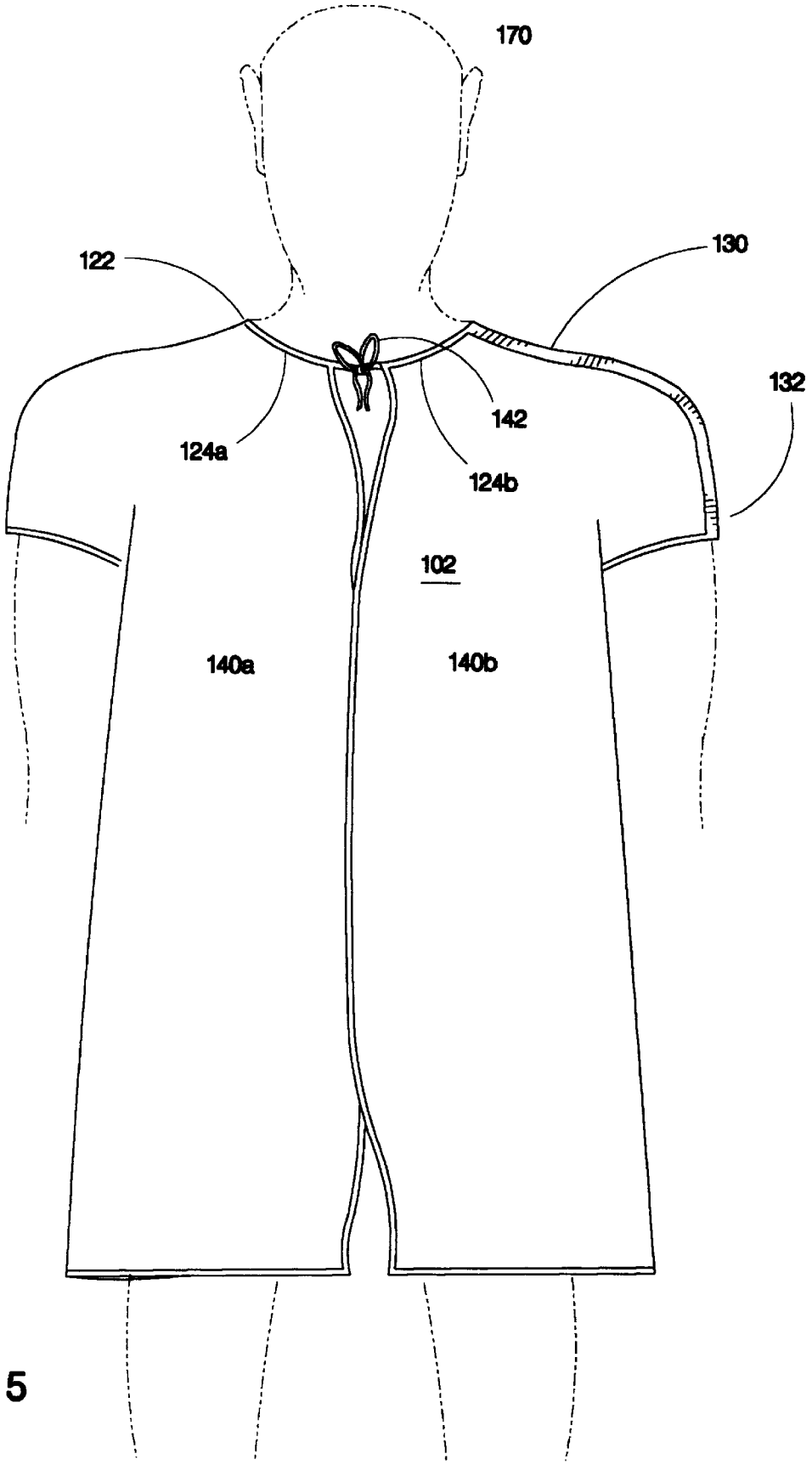
FIG. 5 is a view of a patient wearing the garment of the invention with the two halves of the openable panel tied or secured together and covering the back of the patient.
Figure 6:
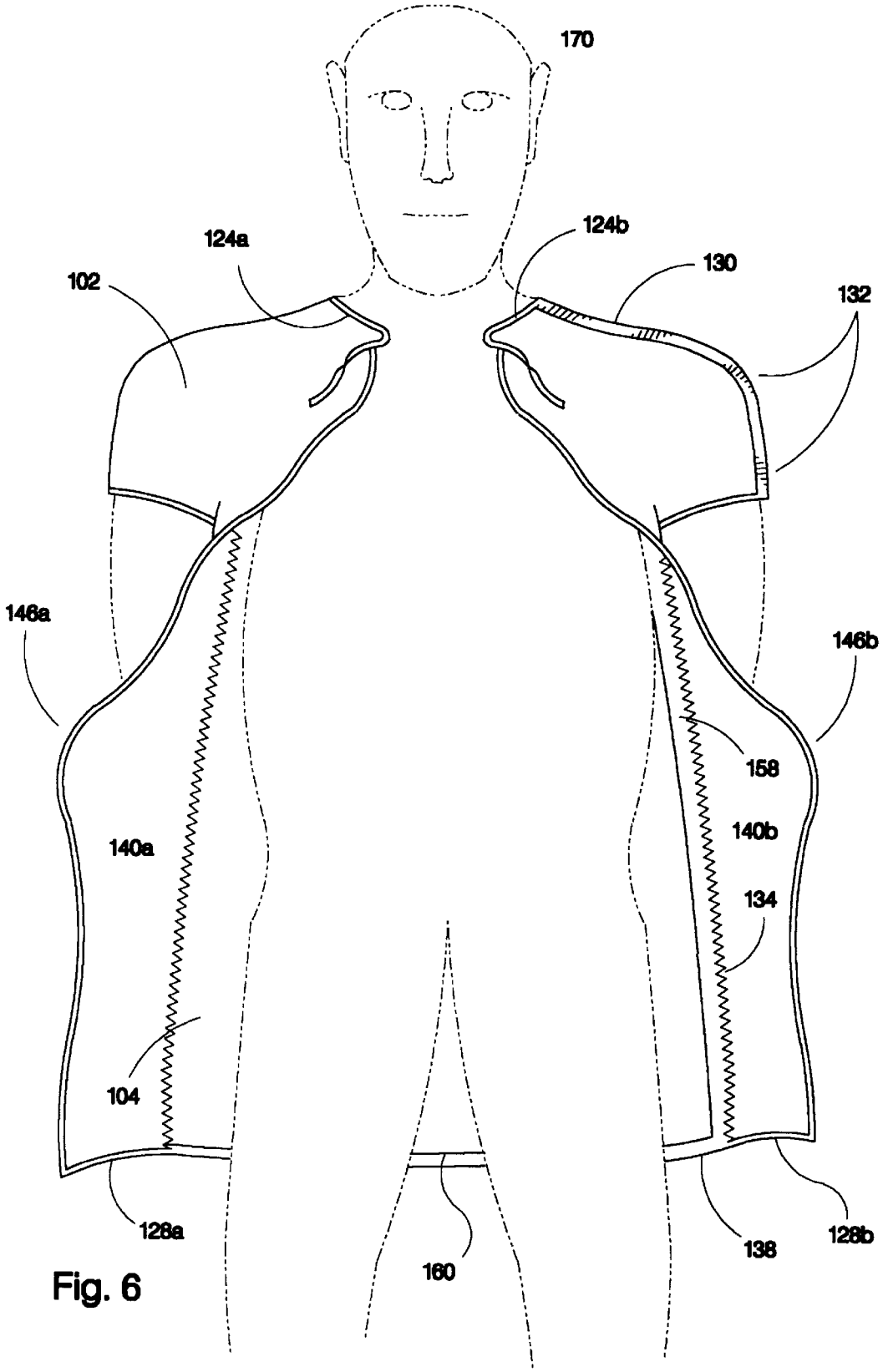
FIG. 6 is a view of the garment being worn with the wearer between the openable and central unitary panels and with the two halves of the openable panel in an open position with respect to the front of the wearer.
Figure 7:
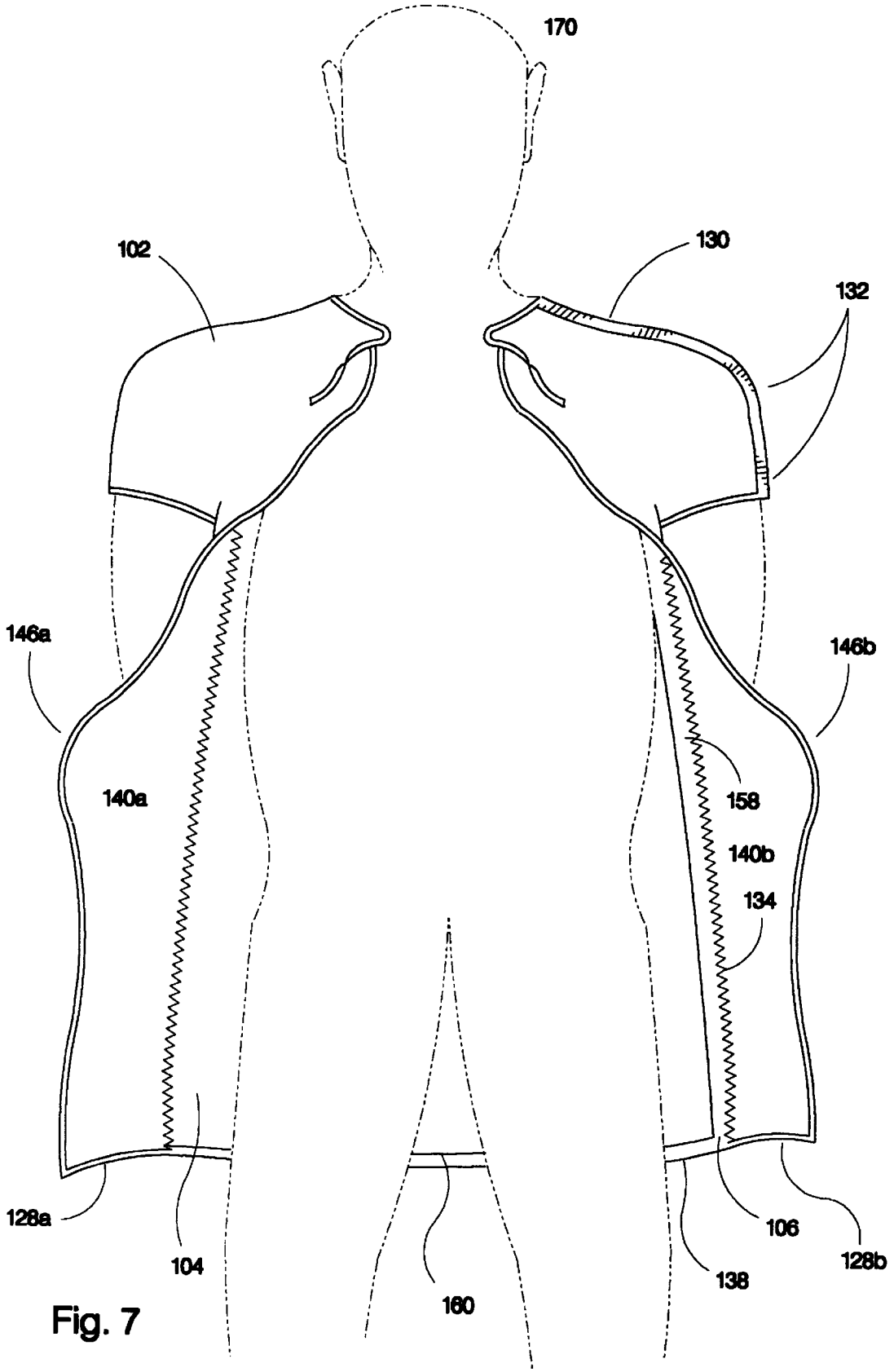
FIG. 7 is a view of the garment being worn with the patient between the openable and central unitary panels and with the two halves of the openable panel in an open position with respect to the back of the wearer.
Figure 8:
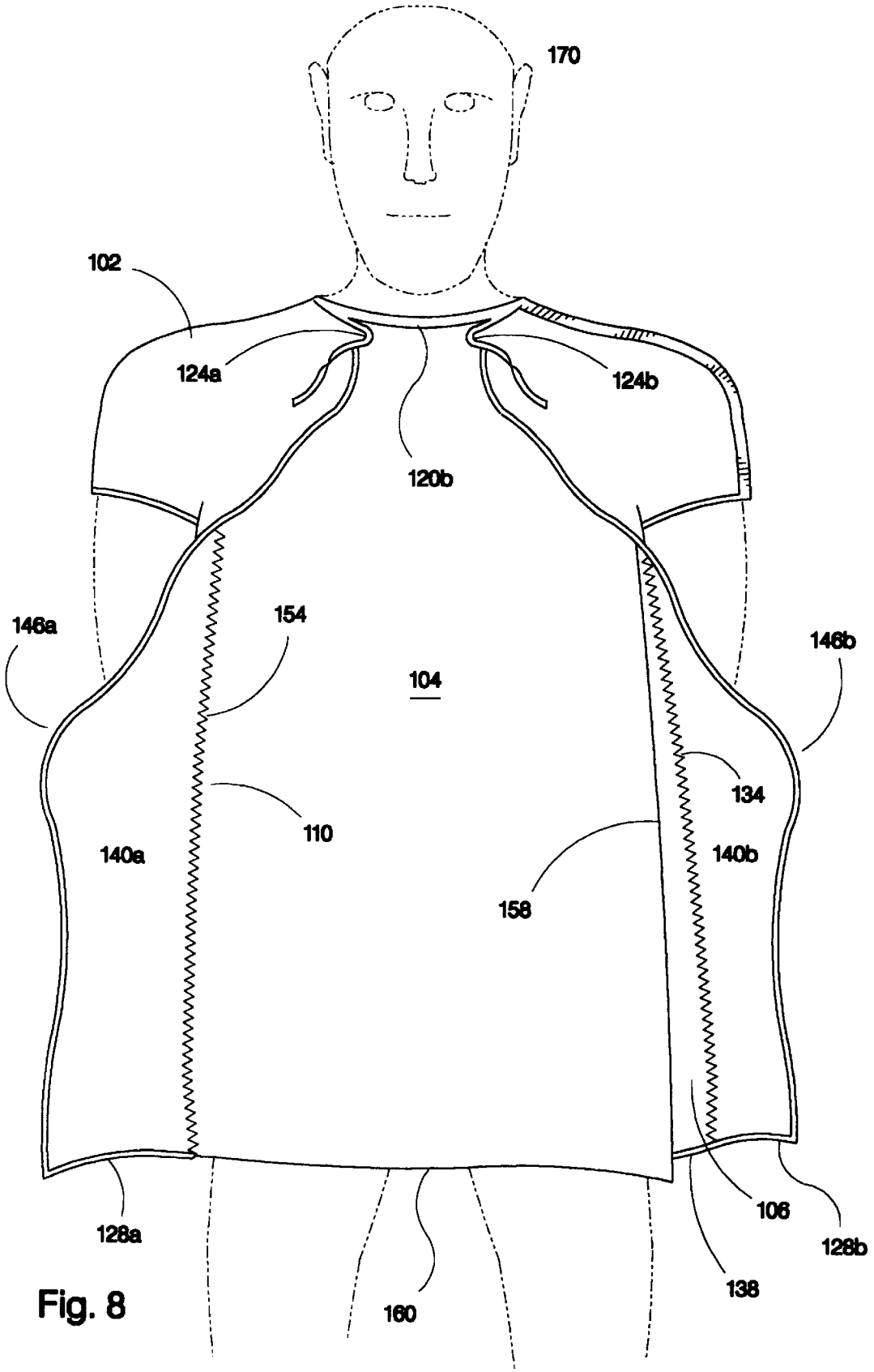
FIG. 8 is a view of the garment worn with the openable panel in front of the patient and the patient between the two unopenable panels.
Figure 9:
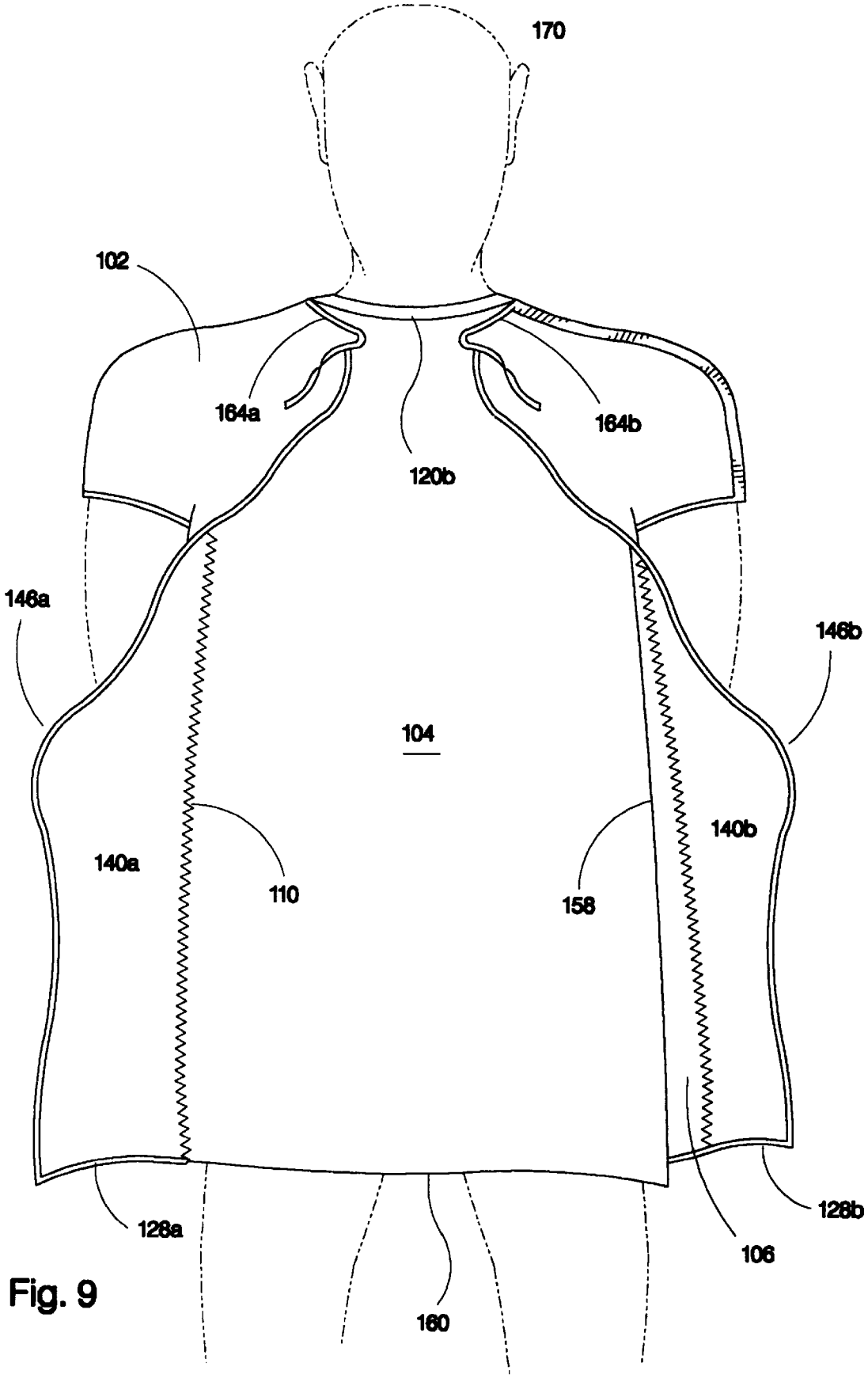
FIG. 9 is a view of the garment worn with the openable panel over the back of the patient and the patient between the two unitary panels.

FIGS. 4 through 9 show the various orientations in which the body garment 100 may be worn. FIGS. 4, 6, and 8 show the body garment being worn with the openable or bifurcated panel 102 covering the front of the patient and with the patient's body either between the first and middle or middle and third panels. FIGS. 5, 7, and 9 show the body garment 100 reversed, with the first, bifurcated, or split panel 102 covering the back of the patient, and again with the patient's body either between the first and middle or middle and third panels. This wide range of possible orientations gives the body garment 100 the versatility needed to accommodate both the functional elements required in a hospital gown as well as the dignity and modesty needs of the patient wearing such a gown.

FIG. 4 is an isometric view of the body garment 100 being worn with the openable or split panel 102 facing or covering the front of the patient 170, and with the flaps 140*a* and 140*b* of the panel 102 held together by the ties 142 in a lap-over fashion. FIG. 5 similarly shows the garment 100 worn with the flaps 140*a* and 140*b* also in a closed and lap-over position, but with the garment 100 reversed so that the split panel 102 is facing or covering the posterior of the patient. Note that in both FIGS. 4 and 5 the patient could be positioned either between the openable and middle panels 102 and 104 or between the two unitary 104 and 106.

FIG. 6 is an isometric view of the body garment 100 being worn with the split panel 102 facing the front of the patient 170 and with the flaps 140*a* and 140*b* untied and substantially opened. In FIG. 6, the patient's body is disposed between the openable and middle panels such that both unitary panels 104 and 106 are disposed adjacent to or covering the patient's back side or posterior.

FIG. 7 shows an isometric view of the body garment 100 being worn similarly to FIG. 6 except with the garment being reversed or turned around so that the first panel 102 is over the back of the patient 170 instead of the front, with the flaps or sections 140*a* and 140*b* being opened to show the orientation of the panels 104 and 106 underneath. In FIG. 7, the unitary panels 104 and 106 are both adjacent to or covering the front of the patient, so that when the two flaps or sections 140*a* and 140*b* of the first panel 102 are opened or untied the back of the patient is immediately exposed for treatment or examination.

FIG. 8 is an isometric view of the body garment 100 worn with the openable or split panel 102 over the front of the patient 170 with the flaps or sections 140*a* and 140*b* untied and in a substantially open position. In contrast to FIG. 6, in FIG. 8 the patient's body is disposed between the solid or unitary panels 104 and 106. In the embodiment shown, the left edge 154 of the central panel 104 is stitched or sewn to the outer panels 102 and 106 along the first seam 110. However, the right edge 158 of the central panel 104 is not attached to the other panels, so that the central panel 104 hangs loosely along such edge 158. Thus, when the garment is worn as shown in FIG. 8, both panels 102 and 104 are covering the front portion of the patient's body while the full panel 106 is completely covering the back posteria of the patient. Note that the patient's body remains substantially covered even though the flaps or sections of the first panel 102 are opened and untied. However, since the edge 158 is not stitched to the panel 106 (not shown in the front), the patient's body is still accessible for treatment if required simply by pulling back the middle panel 104 along edge 158. In addition, the patient can easily slip his or her body between the solid or unitary panels 104 and 106 by unfastening the hook and loop fasteners 132, sliding between the panels and reattaching the fasteners 132, without having to pull the entire garment over his or her head.

FIG. 9 is an isometric view of the garment 100 being worn similarly to what is shown in FIG. 8, except with the garment turned around so that the openable and middle panels 102 and 104 are now covering the posterior of the patient 170 and the unopenable or full panel 106 is covering the front of the patient 170. This configuration is similar to the manner in which a standard or traditional hospital gown is worn, except the central panel 104 protects the patient from unwanted exposure, drafts, etc. Even though the split panel 102 is open and untied, the patient's body remains substantially covered by the unitary central panel 104, while still remaining readily accessible along the left edge 158.

Figure 10:
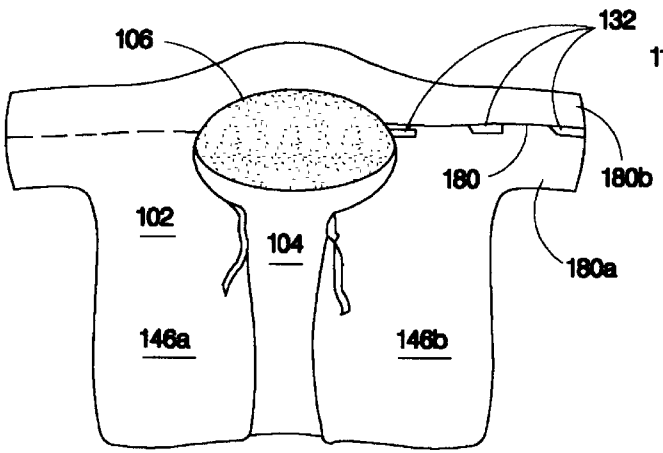
FIG. 10 is a top isometric view of the garment.

FIG. 10 is a top isometric view of the body garment 100 with the split panel 102 being in front of the solid or unitary 5 panels 104 and 106, and with the hook and loop fasteners, generally shown as 132, on the openable left shoulder portion 180 being fastened. The openable shoulder portion 180 is comprised of the first panel shoulder portion 180*a* and the third panel shoulder portion 180*b*. In the illustrated embodiment, the first panel shoulder portion 180*a* is detachably attached along its inner side to the outer side of the third panel shoulder portion 180*b* by fastener 132. In addition, the shoulder edge 182 of the middle panel 104 (shown in FIGS. 11 and 12) is detachably attached to the inner side of the third panel shoulder portion 180*b*. Of course, other arrangements for connecting the panels along the shoulder seam 130 may be used.

Figure 11:
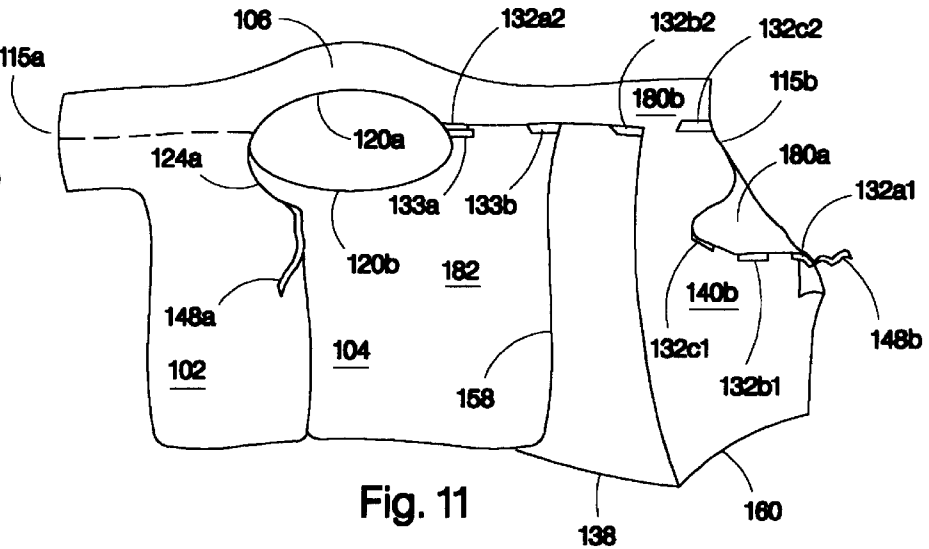
FIG. 11 is a top isometric view of the garment showing the hook and loop fastener of the openable panel unfastened.

FIG. 11 is another top isometric view of the body garment 100 with the first panel shoulder portion 180*a* being unfastened from the hook and loop fasteners 132 and pulled away from the third panel shoulder portion 180*b*, exposing the right edge 158 of the middle panel 104. The individual hook and loop fasteners on the inner side of the first panel shoulder portion 180*a* are labelled as 132*a*1, 132*b*1, and 132*c*1, with the corresponding fasteners on the outer side of the third panel shoulder portion 180*b* labelled as 132*a*2, 132*b*2, and 132*c*2, respectively. Fasteners on the inner side of the third panel shoulder portion 180*b* and the corresponding fasteners on the shoulder edge 182 of the middle panel 104 are shown as 133*a* and 133*b* in FIG. 11. When the split panel 102 is opened along the first panel shoulder portion 180*a* as shown in FIG. 11, a patient can more easily put the garment on by slipping one arm through the arm opening 115*a*, placing his or her body between the first and second panels 102 and 104, and then closing the garment and reattaching the hook and loop fasteners 132 of the arm opening 115*b* and the ties 148*a–b*. The fasteners 132 also provide easy access to the shoulder portion of a patient if a cast or other treatment is required.

Figure 12:
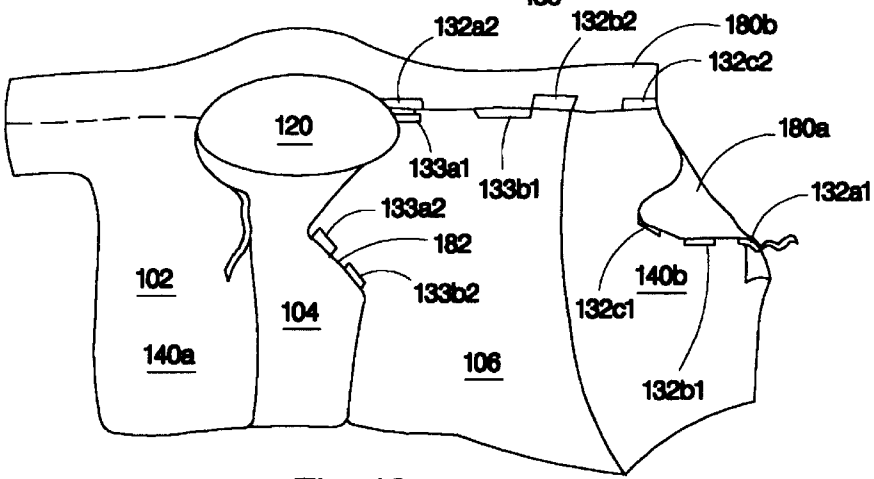
FIG. 12 is a top isometric view of the garment showing the hook and loop fasteners of both the outer and middle panels unfastened and one half of the openable panel folded out to the side.

FIG. 12 is another top isometric view of the body garment 100 with both the first and middle panels 102 and 104 being unfastened from the third panel 106 along the third panel shoulder portion 180*b*. The fasteners on the inner side of the third panel shoulder portion are now more precisely labelled 133*al* and 133*bl*, while the corresponding fasteners on the central panel shoulder edge 182 are labelled 133*a*2 and 133*b*2, respectively. When both the first panel 102 and middle panel 104 are unfastened as shown in FIG. 12, the patient may easily slip or slide his or her neck into the first neck opening 120 and reattach the fasteners on the first and middle panels to the position shown in FIG. 10.

Figure 13:
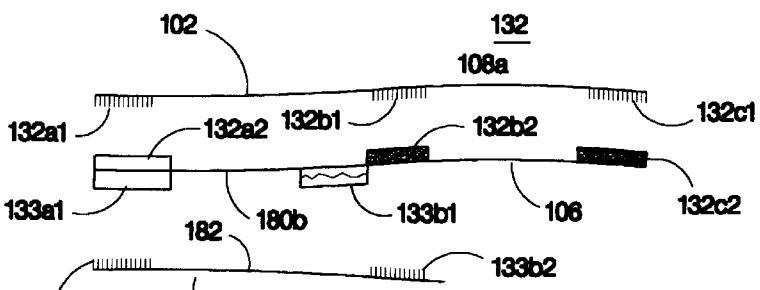
FIG. 13 is a front view of the hook and loop fasteners on the shoulder portion of the garment.

FIG. 13 is a more detailed side view of the hook and loop fastening means 132 on the first shoulder portion 180. Such fasteners are of course well known in the prior art and are attached to the garment as by sewing and the like. In the illustrated embodiment, three such fasteners 132 are used to hold the flap or section 140*b* of the first panel 102 to the outer side of the third panel 106, while two fasteners 133 are used to hold the middle panel 104 to the inner side of the third panel 106. The middle panel 104 is attached along the shoulder edge 182 by fasteners 133*a*2 and 133*b*2 to the corresponding fasteners 133*a*1 and 133*b*1 on the inner side of the third panel shoulder portion 180*b*. Similarly, the first panel shoulder portion 180*a* is attached along its inner side by the fasteners 132*a*1, 132*b*1 and 132*c*1 to the corresponding fasteners 132*a*2, 132b2, and 132*c*2 located on the outer side of the third panel shoulder portion 180*b* as shown. Continuous strips of such hook and loop fasteners 132 and 133 could alternatively be used along the second shoulder seam 130 instead of individual strategically placed fasteners 132. In addition, while modern hook and loop-type fastenings are preferred since they allow the garment panels to be easily unconnected and reconnected, any other suitable-type fastenings such as snaps fastenings, button or button-hole fastenings and the like can be used.

In particular, the hook and loop securing system, frequently referred to by its registered trademark, or brand name, Velcro®, is particularly suitable and convenient where the hospital gown is made from some disposable material such as the cellulose material from which many if not most operating room clothing is made, including doctor scrub suits. Where the gown is formed from a material that will be washed many times, the hook and loop system may not be the best since the hooks particularly of such clothing tend to become clogged with lint and the like during machine washing. For such materials, therefore, conventional buttons, snaps, or even tie systems may be more practical.

As shown in the Figures above, the body garment of the present invention provides a uniquely adaptable hospital gown that can be worn in various different orientations on the body of a patient to better accommodate the patient's needs, while still allowing easy access to the body of the patient at all times for medical treatment and the like. For example, as shown in FIG. 5, the garment can be worn with the openable or split panel 102 covering the patient's back, while the solid or unitary panels 104 and 106 are both covering the patient's front, with the central panel 104 lying under the outer panel 106. In order to wear the gown in this position, generally the patient's head is positioned in the second neck opening 122, defined by the neck edges 120*a*, 124*a* and 124*b*, and the solid or unitary panels 104 and 106 are positioned over the front of the body. Flaps or sections 140*a* and 140*b* are then wrapped around the body of the patient and secured by the ties 142. While generally there is no need to unfasten any of the hook and loop fasteners 132, if the patient has a shoulder or arm injury that immobilizes or restricts the movement of the patient, the fasteners 132 could be detached and the gown then slipped over the arm and shoulder and refastened. Such configuration is similar in overall configuration to the traditional hospital gown.

A patient would likely wear the body garment 100 in the manner shown in FIG. 5 when examination or other treatment of the back or backside of the patient is required. As shown in FIG. 7, simply pulling back one or both of the flaps 140*a* and 140*b* provides quick access to the back and buttocks area of the patient. In addition, an immobilized or particularly feeble patient might wear the gown in such position if he or she required the use of a bedpan or the like.

The panels of the garment could can also easily be reversed and worn as shown in FIG. 4, with the openable panel 102 covering the patient's chest and with the solid panels 104 and 106 covering the back or backside of the patient. In this position, as shown in FIG. 6, the flaps 140*a* and 140*b* can be easily manipulated by a nurse or physician to completely expose the wearer's chest and abdomen, and because the ties 142 are now positioned within easy reach of the patient, they may be easily tied or untied by an able patient without the need for assistance. The body garment is also easily removed similarly to a standard gown or shirt, or alternatively can be removed or changed by a nurse or assistant by unhooking the detachable shoulder fasteners 132 and sliding the gown off of the wearer without disturbing any intravenous connections or the like.

Thus, the garment of the present invention can be worn such that the first panel generally serves to cover one aspect or portion of the wearer's torso, either the front aspect of the torso as shown in FIGS. 4 and 6, or the back aspect of the torso, as shown in FIGS. 5 and 7, with the solid or unitary panels 104 and 106 substantially covering the opposite aspect of the wearer's torso. Such configurations are generally similar or analogous to a standard hospital gown, but the addition of the extra or middle panel 104 creates a double layer of material over one side of the patient, which not only creates a warmer gown than the traditional gown, but also has the unexpected benefit of providing additional cushioning or lining should the wearer be forced to lie with his or her body on top of the double-layered gown for an extended period of time. Although not shown in the illustrated embodiment, if desired the middle panel 104 could also be easily made to be completely detachable from rest of the garment 100, and such gown could then be worn using just the outer panels 102 and 106. On the other hand, the central panel 104 can also be with proper adjustments easily added to a standard gown, converting it into a more versatile and attractive garment.

Figure 14:
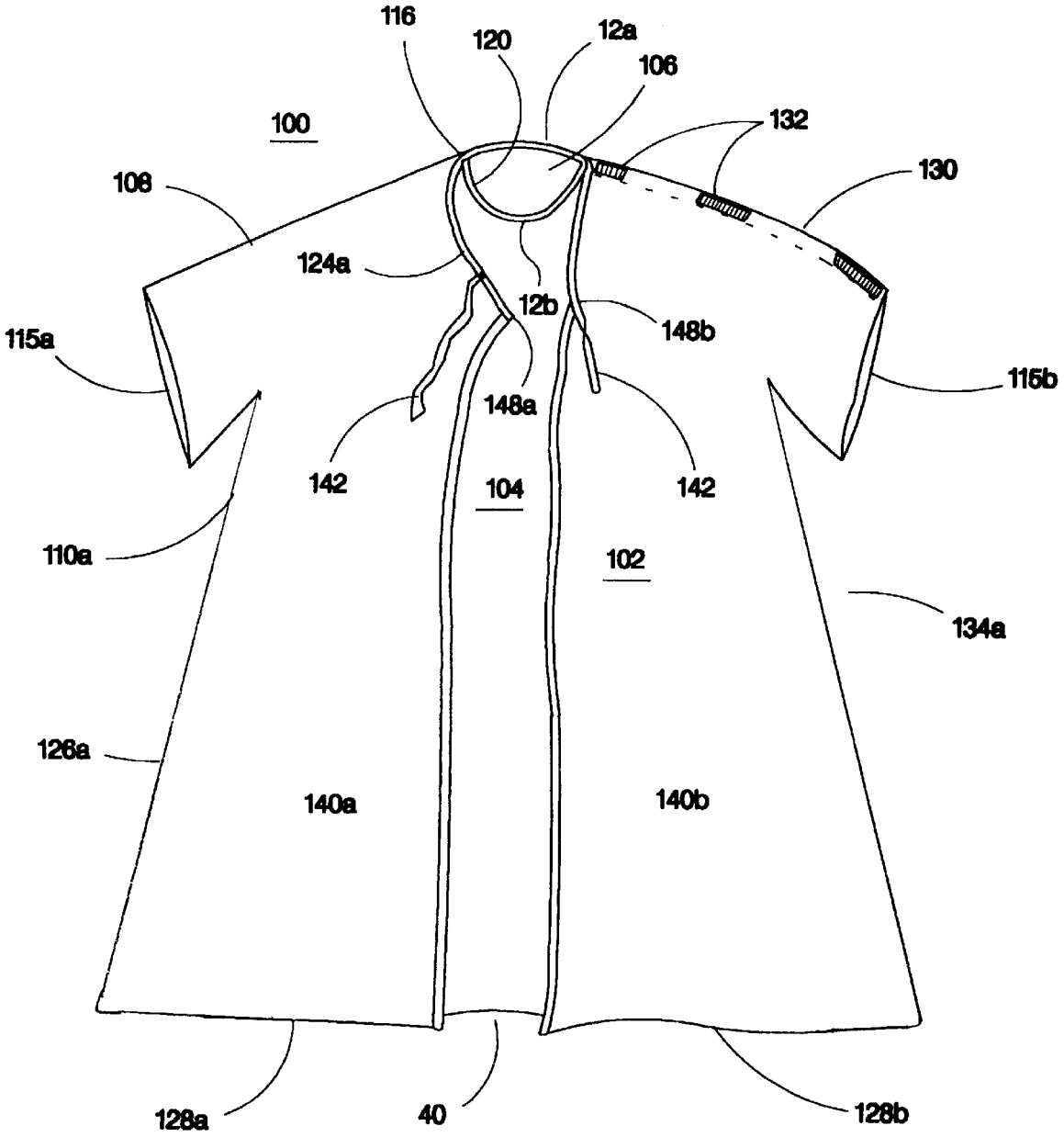
FIG. 14 is an isometric view of an alternative embodiment of the invention with the panels of the garment cut wider than the primary embodiment.

As shown in FIGS. 4 and 5, the panels of the garment should be long enough to cover substantially the whole torso of the wearer, and the combined width should be sufficient to cover or wrap around the wearer when the wearer is sitting, standing, or lying down. However, to accommodate patient's having a pear-shape or needing additional space due to their girth, the inventor contemplates another preferred embodiment, shown in FIG. 14, wherein the second panels are cut so that the side seams and arm openings 102–106 are generally wider than the already described embodiment, resulting in an overall body garment having generally larger dimensions. In addition, FIG. 14 shows one of the ties 142 moved inwardly from the edge 148*a* to accomodate a preferred overlap affect and to further enhance the dignity of the wearer.

Described in general terms, it may be said that each panel will have a major dimension from top to bottom and two minor dimensions from side to side, the length of the wearer's torso plus part of the legs fitting into or adjacent to the major dimension of the panel and the width of the wearer's torso fitting into or being adjacent to the minor dimensions. The upper minor dimension is provided with at least one opening for the neck of the patient and one section on one side of the neck opening is only temporarily secured together while the opposite side is preferably permanently secured together. Likewise, one side of the major dimension of all panels are preferably permanently secured together, while the opposite side of the central panel is preferably at best only temporarily secured. The upper minor dimension will normally be less than the lower minor dimension, but the exact amount of difference will depend upon the general cut or flare of the garment from top to bottom.

Although the garment 100 as described in the preferred embodiments should provide adequate cover to anyone wearing it, if more covering is desired, or if there is no immediate need for the garment to be opened for examination, treatment or the like, the garment can be worn with the body positioned between the solid or unitary panels 104 and 106, as shown in FIGS. 8 and 9. To situate the garment 100 as shown in FIGS. 8 or 9, the garment can either be slipped over the head of the patient or wearer, similar to putting on a t-shirt or sweater, or, more preferably, the fasteners generally designated as 132 along the shoulder portion 180 can be unhinged or unhooked as illustrated in FIGS. 3 and 12. Once unhinged, the patient can easily slip his or her body between the second and third panels 104 and 106, with the patient's neck situated in the second neck opening 120. The fasteners 132 are then reconnected to the position shown broadly in FIGS. 1 and 10. The first and second panels 102 and 104 may be situated so that they are covering either the front of the patient as shown in FIG. 8, or reversed and covering the back of the patient as shown in FIG. 9, with the full panel 106 covering the opposite side of the patient's torso.

As is evident from FIGS. 8 and 9, when the garment 100 is worn as shown, the addition of the solid middle panel 104 adds a great deal of covering capacity to the garment 100, and alleviates any worries of accidental exposure due to possible splitting or pulling apart of the flaps 140*a* and 140*b*, a problem that is commonly associated with the standard hospital gown in use today. Even if ties 142 are untied and the flaps 140 and 140*b* split or pull apart as illustrated in FIGS. 8 and 9, the torso of the wearer remains completely covered. However, because the middle panel 104 is not attached to the other panels along the side seam 158, the body of the wearer remains easily accessible along such side seam, as the middle panel 104 can be easily moved to expose the body of the wearer underneath. This element of the present invention is critical, since it allows medical personnel to immediately access the patient's torso or back area to examine wounded areas or in the event of a medical emergency or the like. In addition, the use of detachable hook and loop fasteners along the shoulder edge 158 of the middle panel 104 allows such central panel 104 to be completely opened or removed from the patient's body, allowing direct access to the neck and shoulder area if desired.

In addition to the obvious advantage of providing the wearer with substantially more covering and dignity while still allowing immediate access to the torso area of the wearer, when the garment is worn as shown in FIGS. 8 or 9, it also has the advantage of being warmer than the standard hospital gown. While the splitting apart of the flaps of a standard gown often leads to embarrassing exposure, it also allows cold air or drafts to easily flow between such flaps directly onto the exposed and often extremely sensitive skin and torso of the patient. However, the addition of the unopenable middle panel 104 allows the wearer to be completely covered, thereby significantly decreasing the volume of cold air or drafts contacting the torso area. Should the wearer become too warm or simply desire to switch the position of the middle panel 104 so that the wearer's body is between the first and middle panels 102 and 104, this can be accomplished with or without the help of a nurse or attendant either by taking the gown off and putting it back on in the desired position, or, without ever removing the garment, by simply unfastening the middle panel 104 along the shoulder edge 182, repositioning such panel on the opposite side of the body, and reattaching the fasteners 132. Thus, a patient wearing the gown of the present invention can more easily and exactly regulate his or her level of comfort, for example, as he or she is moved between examination rooms of different temperatures, or simply based on the sensitivity or tastes of individual patients.

As shown in FIGS. 4–9, the inventor's body garment fully covers the wearer's chest, back and shoulders in each configuration or orientation in which it is adapted to be worn. The overall length of the garment may vary with the intended use. If used as a hospital gown, the garment should be long enough to cover the wearer's torso. However, other shorter garments could also be provided for use for example as protective garments. The garment could even potentially be adapted for use as an attractive dress or smock wherein for example the panels could utilize contrasting colors or styles, and the wearer could change the appearance of the garment depending upon how the body is positioned between such panels. Other types of closure means may also be provided to secure the panels of the garment in the desired position. For example, when used as other than a hospital gown, the flaps or pieces of the first panel 102 could even be modified such that they could be closed using a zipper or the like. Thus, the addition of the middle panel provides the garment with a unique versatility not seen in any garments found in the prior art.

While the outer portion of the hospital gown has been described as being comprised of two panels forming a reversible front and back or rear and forward portions of the garment, it should be understood that the outer portions of the garment may comprise a single length of fabric wrapped completely about a patient's torso and open or split on one side to provide access and egress for the patient's body. Within such outer covering will be positioned a central panel preferably attached to one side of the outer sheath and extending across the openable section forming, in effect, internal chambers for receipt of the torso of a patient. Preferably, the central panel will be attached to one side of the sheath one-quarter of the circumference of the sheath from the opening in the side and is also preferably attached to the shoulder section on the same side and temporarily attached, or detachably connected to the shoulder section on the opposite side, but preferably not to the longer portion on the opposite side. Since the human body is wider that it is deep, due to a wide shoulder girdle, any such body covering design tends to be flattened from the front to back creating a configuration tending to the same form as is created by the opposition of two panels.

While the present invention has been described at some length and with some particularity with respect to the several described embodiments, it is not intended that it should be limited to any such particulars or embodiments or any particular embodiment, but it is to be construed with reference to the appended claims so as to provide the broadest possible interpretation of such claims in view of the prior art and, therefore, to effectively encompass the intended scope of the invention.

I claim:

1. A body garment having two alternative torso encompassable cavities adapted for alternative modes of wearing comprising:

(a) a first outer panel having major and minor dimensions sufficient to extend in a covering relationship adjacent a major portion of a human torso, (b) a second outer panel having generally similar dimensions as the first panel, (c) the second panel being at least temporarily securable to the first panel along a portion of the peripheries of both panels, (d) a third panel having generally similar dimensions positioned between the first and second outer panels and at least temporarily secured to at least one of the first and second panels such that separate torso encompassable cavities are defined between the first and third panels and between the second and third panels, and (e) wherein at least a portion of a panel defining one side of at least one of the two cavities can be displaced to provide access to a human torso disposed in said cavity.

2. A body garment in accordance with claim 1 wherein the panel defining the outer panel of at least one of the two cavities is formed of two separate portions which can be displaced from each other to provide access to a human torso disposed in such cavity.

3. A body garment in accordance with claim 2 wherein the two portions of the outer panel defining one side of at least one of the two cavities comprises substantially two halves of said panel securable to each other along a midline.

4. A body garment in accordance with claim 3 wherein the midline along which the two halves of the outer panel are securable is substantially vertical.

5. A body garment in accordance with claim 2 wherein the first and second outer panels are secured to each other along a substantial portion of one major periphery of the panels and the first, second and third panels are at least temporarily securable to each other along a portion of the minor dimension of the panels to hold the panels together and form a head and neck opening at one end of the garment.

6. A body garment in accordance with claim 5 wherein the first, second, and third panels are secured to each other along one major dimension and along a portion of one minor dimension and detachably securable to each other along the remainder of said one minor dimension.

7. A body garment in accordance with claim 6 wherein the minor dimension end of the first and second panels where the panels are secured is provided with extensions forming sleeves at such minor dimension end of the panels.

8. A body garment in accordance With claim 7 wherein the minor dimension of the first, second, and third panels at which such panels are securable is lesser in dimension that the lesser dimension of the panels on the unsecured end.

9. A body garment to be worn by a hospital patient in one of at least four alternative modes utilizing two alternatively usable body cavities comprising:

(a) first, second, and third panels, said panels being in side-by-side relationship, with said second panel being positioned between said first and third panels and providing body encompassable cavities on opposite side of said second panel, said third panel being vertically split into two segments, each of said panels having an upper edge defining a neckline and the first and third panels having sleeve sections secured at least temporarily to each other to form garment sleeves, a lower edge defining a hem line, and generally vertically extending side edges;

(b) means for interconnecting at least temporarily the panels along said upper edges and at least one of said side edges;

(c) means for holding the segments of the vertically split panel together; and (d) means for removably securing the garment along at least one of the sleeve sections of each of said panels.

10. The garment in accordance with claim 9 wherein said first and third panels are formed from a single sheet of material.

11. The garment in accordance with claim 9 wherein said first and third panels are formed from three separate sheets of material.

12. A body garment adapted particularly for wear by patients in hospital environments in one of at least four alternative modes comprising:

(a) at least one panel forming an outer torso encompassing sheath having a side opening, the torso encompassing sheath having the general configuration of a human torso with a greater and lesser width dimension, (b) a central panel Within the outer sheath generally aligned with the wider dimension, (c) at least one temporarily closed shoulder section at the upper portion of the outer torso encompassing sheath with the central panel at least temporarily secured to such sections, and (d) where in the outer sheath and central panel have sufficient dimensions and room between them when the garment is in use to accommodate a human torso between the outer sheath and central panel with the central panel extending across one of the front or back of the torso of the wearer.

13. A body garment in accordance with claim 12 wheriein the outer sheath is composed of at least two outer panel sections.

14. A body garment in accordance with claim 13 wherein the central panel is attached to one side of the outer sheath but not to the other.

15. A body garment in accordance with claim 14 wherein the central panel is attached to one closed shoulder section and removably attached to another shoulder section.

16. A hospital gown comprising first, second, and third interconnected panels arranged consecutively and adapted to extend about the torso of a wearer and having dimensions and being attached to each other such that two of the panels can encompass the torso of a wearer while the remaining panel extends adjacent one of the two encompassing panels as well as the torso of the wearer with insufficient room between the panels to accommodate an additional torso.

17. A garment in accordance with claim 16 wherein the first panel extends across the front of a wearer and the two other panels extend across the back of the wearer.

18. A garment in accordance with claim 16 wherein the first panel extends across the back of a wearer and the two other panels extend across the front of the wearer.

19. A garment in accordance with claim 16 wherein first and second panels extend across the front of a wearer and the third panel extends across the back of the wearer.

20. A garment in accordance with claim 16 wherein the first and second panels extend across the back of the wearer and the third panel extends across the front of the wearer.

21. A garment in accordance with claim 16 wherein the third panel is only temporarily securable to the first panel along a portion of the peripheries of both panels.

22. A garment in accordance with claim 16 wherein the second panel is only temporarily securable to at least one of the first and third panels.

23. A garment in accordance with claim 16 additionally wherein one of the first and third panels is segmented into two partial panels by a vertical division and further comprising a means for detachably securing the two partial panels together.

24. A garment in accordance with claim 23 including sleeve means on the two outer panels and further including temporary securing means along at least one of the sleeve sections of each of said panels.

25. A garment in accordance with claim 23 wherein the wearer can move the second panel from a position extending across the front of the torso to a position extending across the back of the torso and vice versa without removing the garment.

26. A garment in accordance with claim 16 wherein the second panel provides added warmth and privacy to the wearer.

27. A body garment adapted for alternative modes of wearing comprising:

(a) a first panel having major and minor dimensions sufficient to extend in a covering relationship adjacent a major portion of a human torso, (b) a second panel having generally similar dimensions as the first panel, (c) the second panel being at least temporarily securable to the first panel along a portion of the peripheries of both panels, (d) a third panel positioned between the first and second panels and at least temporarily secured to at least one of the first and second panels in a manner such that two alternative torso encompassable cavities are defined between the several panels, and (e) wherein at least a portion of panel a defining one side of at least one of the two cavities can be displaced to provide access to a human torso disposed in said cavity, (f) wherein the two portions of the panel defining one side of at least one of the two cavities is comprised of substantially two halves of said panel securable to each other along a midline, (g) wherein the first and second panels are secured to each other along a substantial portion of one major periphery of the panels and the first, second and third panels are at least temporarily securable to each other along a portion of the minor dimension of the panels to hold the panels, together and form a head and neck opening at one end of the garment, (h) wherein the first, second, and third panels are secured to each other along one major dimension and somewhat less than one-half of one minor dimension and securable to each other along somewhat less than one-half of the remainder of said one minor dimension, (i) wherein the minor dimension end of the first and second panels where the panels are at least partially secured is provided with extensions at least partially securable to each other forming sleeves at such minor dimension end of the panels, and (j) wherein the minor dimension of the first, second, and third panels at which such panels are at least temporarily securable are lesser in dimension that the lesser dimension of the panels on the unsecured end.

28. A body garment adapted particularly for wear by patients in hospital environments comprising:

(a) at least one panel forming an outer torso encompassing sheath having a side opening, the torso encompassing sheath having the general configuration of a human torso with a wider dimension and less width dimension, (b) a central panel within the outer sheath generally aligned with the wider dimension, (c) at least temporarily closed shoulder sections at the upper portion of the outer torso encompassing sheath with the central panel at least temporarily secured to such sections, (d) wherein the outer panel is composed of at least two outer panel sections, and (e) wherein the central panel is attached to one side of the outer panel, but not to the other.

29. A body garment in accordance with claim 28 wherein the central panel is attached to one closed shoulder section and removably attached to the other.

* * * * *